US006724316B2

(12) United States Patent
Addy et al.

(10) Patent No.: US 6,724,316 B2
(45) **Date of Patent: *Apr. 20, 2004**

(54) METHOD AND APPARATUS FOR DETECTION OF MOTION WITH A GRAVITATIONAL FIELD DETECTOR IN A SECURITY SYSTEM

(75) Inventors: Kenneth L. Addy, Massapequa, NY (US); Kenneth G. Eskildsen, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 39 days.

This patent is subject to a terminal disclaimer.

(21) Appl. No.: 10/282,663

(22) Filed: Oct. 29, 2002

(65) Prior Publication Data

US 2003/0071739 A1 Apr. 17, 2003

Related U.S. Application Data

(63) Continuation-in-part of application No. 09/982,357, filed on Oct. 16, 2001, now Pat. No. 6,472,993.

(51) Int. Cl.[7] ..... G08B 21/00

(52) U.S. Cl. ..... 340/686.1; 340/545.1; 340/545.6; 340/545.9; 340/547; 340/539.1; 340/693.3; 340/571; 340/551; 340/552

(58) Field of Search ..... 340/686.1, 545.1, 340/545.6, 545.9, 547, 539.1, 693.3, 571, 551, 552

(56) References Cited

U.S. PATENT DOCUMENTS

| | | | |
|---|---|---|---|
| 3,573,817 A | 4/1971 | Akers | |
| 3,725,890 A | 4/1973 | Cirino | 340/262 |
| 3,745,553 A | 7/1973 | Kardashian | |
| 3,786,674 A | 1/1974 | Skujins, Jr. | 73/71.4 |
| 3,962,693 A | 6/1976 | Schamblin | 340/261 |
| 4,057,791 A | 11/1977 | Bimmerle et al. | 340/261 |
| 4,207,770 A | 6/1980 | Grushow | 73/517 R |
| 4,333,029 A | 6/1982 | Kolm et al. | 310/329 |
| 4,361,740 A | 11/1982 | Stockdale | 200/61.45 R |
| 4,424,631 A | 1/1984 | Franks | |
| 4,546,551 A | 10/1985 | Franks | |
| 4,681,991 A | 7/1987 | Anderson | |

(List continued on next page.)

FOREIGN PATENT DOCUMENTS

| | | |
|---|---|---|
| WO | WO 01/37236 A1 | 5/2001 |
| WO | WO 02/35490 A1 | 5/2002 |

OTHER PUBLICATIONS

White, Tim; A New Sensor ASIC for Changing Magnetic Fields, www.sensormag.com, Mar. 2000.
Vector Compass Application Notes.
Analog Devices ADXL202E Low–Cost +/–2g Dual–Axis Aceleromter with Duty Cycle Output, Rev. A.

*Primary Examiner*—Daniel J. Wu
*Assistant Examiner*—Tai T. Nguyen
(74) *Attorney, Agent, or Firm*—Anthony R. Barkume, PC

(57) ABSTRACT

In a first aspect, the present invention is a method, apparatus, and system for detecting a change in position of a door or a window in an alarm system with a singular housing having a magnetometer for monitoring the magnetic field of the earth, and a microprocessor for detecting a change in the position of the singular housing with respect to the magnetic field of the earth. The microprocessor generates an alarm signal upon detecting the change, and causes the alarm signal to be transmitted, by wireless transmission, to a remote receiving station. The device may also be used to determine if an object that it is affixed to has been moved, such as for a theft alarm for an object such as a painting. In a second aspect of the invention, a gravitational sensor is used to monitor the gravitational field of the earth and determine if an associated object or person has been moved with respect to the gravitational field, thus providing motion detection and signaling an alarm.

21 Claims, 6 Drawing Sheets

U.S. PATENT DOCUMENTS 4,845,464 A 7/1989 Drori et al.
4,884,067 A 11/1989 Nordholm et al.
4,938,476 A 7/1990 Brunelle et al.
5,045,839 A 9/1991 Ellis et al.
5,258,743 A 11/1993 Nelson et al.
5,341,097 A * 8/1994 Wu ..... 324/207.2
5,402,107 A 3/1995 Rencavage
5,534,849 A 7/1996 McDonald et al.
5,559,358 A 9/1996 Burns et al.
5,654,686 A 8/1997 Geschke et al.
5,767,467 A * 6/1998 Grant ..... 200/61.52
5,807,111 A 9/1998 Schrader
5,915,278 A 6/1999 Mallick
6,249,225 B1 6/2001 Wang
6,310,549 B1 10/2001 Loftin et al.
6,472,993 B1 * 10/2002 Addy ..... 340/686.1

* cited by examiner

METHOD AND APPARATUS FOR DETECTION OF MOTION WITH A GRAVITATIONAL FIELD DETECTOR IN A SECURITY SYSTEM

CROSS-REFERENCE TO RELATED APPLICATIONS

This application is a continuation-in-part application of U.S. application Ser. No. 09/982,357, filed on Oct. 16, 2001, now U.S. Pat. No. 6,472,993, issued on Oct. 29, 2002.

BACKGROUND OF THE INVENTION

This invention relates generally to the use of a single housing detector device for sensing movement of the device and signaling an alarm signal in a security system, and in particular, in a first aspect, to a single housing wireless sensor that detects a change in the position of a door or window to which the housing is attached by detecting a change in the magnetic field of the earth. In a second aspect, an alarm device senses changes in position of the housing with respect to the surrounding gravitational field in order to trigger an alarm in a security system.

Conventional door or window sensors in security systems contain two housings; one housing with a magnet, and one housing with a sensor such as a reed switch, which is a miniature encapsulated switch that is activated by a magnetic field. One of the housings is mounted to the door or window (entrance closure) being monitored and the other housing is mounted to the doorjamb or windowsill associated with the entrance closure being monitored. When the entrance closure is closed and the magnet is in close proximity to the reed switch sensor, the sensor produces an output signal that indicates that the door is in its closed position. Once the entrance closure is moved the magnet is not in close proximity to the reed switch sensor and the sensor produces an output signal that indicates the door is not in its closed position. The output signal is periodically read by the alarm system controller, and when the signal indicates that the door is not in its closed position, the alarm system controller activates an alarm condition. The alarm system controller may receive this information through wired or wireless transmission. Alarm systems of this type are described in U.S. Pat. Nos. 4,677,424; 4,339,747; 3,896,427; 3,668,579; 4,359,719; and 4,241,337.

Alarm systems using reed switch sensors, as described above, are reasonably successful in many applications, although there are a number of drawbacks as follows:

1) There is additional cost and time, during installation, for the installer to mount a second device (i.e. the magnet).
2) The position of the magnet in conjunction with the sensor is often critical and the installer spends time shimming and locating the magnet to optimize the reed to magnet gap.
3) Reed switches, which are glass encapsulated switches are fragile and may be damaged at the time of installation.
4) Sensors with two housings can be defeated during the period when the system is in the disarmed state by the addition of an extra magnet taped to the sensor housing. This maintains the reed in its closed position even if the door is opened during an armed state.

It is therefore an object of the design to deliver improved security to the system, since any attempt to tamper with the device by adding a magnet would cause an alarm condition.

It is therefore an object of the present invention to provide an entrance closure sensor that is contained in a single housing.

It is a further object of the present invention to provide an entrance closure sensor with improved sensor reliability.

In another aspect of the field of motion detection, sensors designed for asset protection monitor the asset's location to determine if it is where it should be. If it is determined that the asset is not where it should be, an alarm signal is annunciated. The asset could be an object or a person. For the object, such as a laptop computer, protection would be to determine that the computer has not left the premises without authorization. For a person, such as a firefighter or elderly relative, protection would be to determine that the person was still upright and moving when they should be.

Others have developed devices to perform this task but these devices are either overly complex, expensive, unreliable, or difficult to use. One such device tracks objects by monitoring a marker affixed to the object that periodically sends RF identification signals. Sensors installed at the perimeter of the protection zone detect a breach of the perimeter when the object marker passes the sensor. Disadvantages of this system include short battery life due to the repetition rate of the transmissions and non-detection of the alarm if the asset is hidden within the premises. Another such device is a pendant worn by a person to be protected. If the person feels threatened or becomes ill they press a button on the pendant to annunciate the alarm. A disadvantage of this system is if the person becomes disabled and is unable to press the button, no alarm will be annunciated. Another device similar to our invention uses a dual-axis accelerometer mounted in a notebook PC card that monitors the motion of the PC. If the PC travels a certain distance the PC is disabled. This system differs from ours because it is not wireless, it is not battery powered, there is no alarm annunciation, and its detection method is based the acceleration due to on motion, not the gravitational attraction to the Earth as in our invention.

It is therefore a further object of the invention to provide a device that can sense the movement of an object or person with which the device is associated; i.e. by attachment.

SUMMARY OF THE INVENTION

In accordance with these and other objects, the present invention in a first aspect is a method, an apparatus, and a system for detecting a change in position of an entrance closure in an alarm system, wherein the entrance closure is either a door or a window.

The method of this first aspect of the invention comprises the steps of attaching a singular housing on an entrance closure; monitoring, with apparatus in the housing, the magnetic field of the earth, detecting a change in the position of the housing with respect to the magnetic field of the earth, generating an alarm signal upon detecting a change in position of the housing with respect to the magnetic field of the earth that exceeds a first predetermined threshold, and transmitting by wireless transmission the alarm signal to a remote receiving station.

The apparatus of this first aspect of the invention comprises a singular housing with means for monitoring the magnetic field of the earth, means for detecting a change in the position of the housing with respect to the magnetic field of the earth, means for generating an alarm signal upon detecting a change in position of the housing with respect to the magnetic field of the earth, and means for transmitting by wireless transmission the alarm signal to a remote receiving station. The alarm signal may contain a programmable unique transmitter identification number that allows the receiving station to decipher which sensor has sent the alarm message. The monitoring of the magnetic field of the earth is performed by a magnetometer that senses the earth's magnetic field and generates an output signal correlated to the earth's magnetic field. A microprocessor detects a change in the position of the housing by sampling the magnetometer's output signal at predetermined intervals and determining if the sampled output is different from a stored static (initial) output. If the sampled output is different from the stored static output by a first predetermined amount the microprocessor generates an alarm signal and causes the alarm signal to be transmitted. In addition, if the sampled output is different from the stored static output by a second predetermined amount, the microprocessor generates a trouble signal, wherein the second predetermined amount is less than the first predetermined amount. This may occur when the door or window is slightly ajar. This feature is useful to a user during arming of the alarm system, wherein the user can ensure the entrance enclosures are closed prior to vacating the premises being monitored.

The alarm system of this first aspect of the invention comprises the apparatus described above for detecting a change in position of an entrance closure, and a receiving station, located remotely from the apparatus. The receiving station comprises means for receiving by wireless transmission the alarm signal from the apparatus, and means for indicating an alarm condition in response to the receipt of the alarm signal.

The step of detecting a change in the position of the housing with respect to the magnetic field of the earth may take place on three axes and the generation of an alarm signal may occur upon detecting a change in position of the housing in two of the three axes.

In order to provide security with less false alarms, the remote receiving station may correlate the alarm signal from the apparatus of the present invention with a second alarm signal from a different sensor, which may be a motion sensor.

In a second aspect of the invention in this field of motion detection, a sensor that detects changes in the earth's gravitational field is used to detect motion. The method comprises the steps of locating a housing with respect to an object; monitoring, with apparatus in the housing, the gravitational field of the earth; detecting a change in the position of the housing with respect to the gravitational field of the earth; generating an alarm signal upon detecting a change in position of the housing with respect to the gravitational field of the earth that exceeds a first predetermined threshold, and transmitting by wireless transmission the alarm signal to a remote receiving station.

The housing is located with respect to the object, for example, by affixing the housing to the object (such as by attaching it to a valuable painting, a laptop computer, etc.). The housing may also be hung from an object, such as by placing it on a chain around a person's neck, or around the person's wrist, etc.

The apparatus of this second embodiment comprises a housing with means for monitoring the gravitational field of the earth, means for detecting a change in the position of the housing with respect to the gravitational field of the earth, means for generating an alarm signal upon detecting a change in position of the housing with respect to the gravitational field of the earth, and means for transmitting by wireless transmission the alarm signal to a remote receiving station. The alarm signal may contain a programmable unique transmitter identification number that allows the receiving station to decipher which sensor has sent the alarm message. The monitoring of the gravitational field of the earth is performed by a device that senses the earth's gravitational field and generates an output signal correlated to the earth's gravitational field. A processor detects a change in the position of the housing by sampling the output signal at predetermined intervals and determining if the sampled output is different from a stored static (initial) output by a predetermined amount. If the sampled output is different from the stored static output by a first predetermined amount the microprocessor generates an alarm signal and causes the alarm signal to be transmitted. In addition, if the sampled output is different from the stored static output by a second predetermined amount, the microprocessor generates a trouble signal. The second predetermined amount may be less than the first predetermined amount.

DETAILED DESCRIPTION OF THE PREFERRED EMBODIMENT

Figure 1:
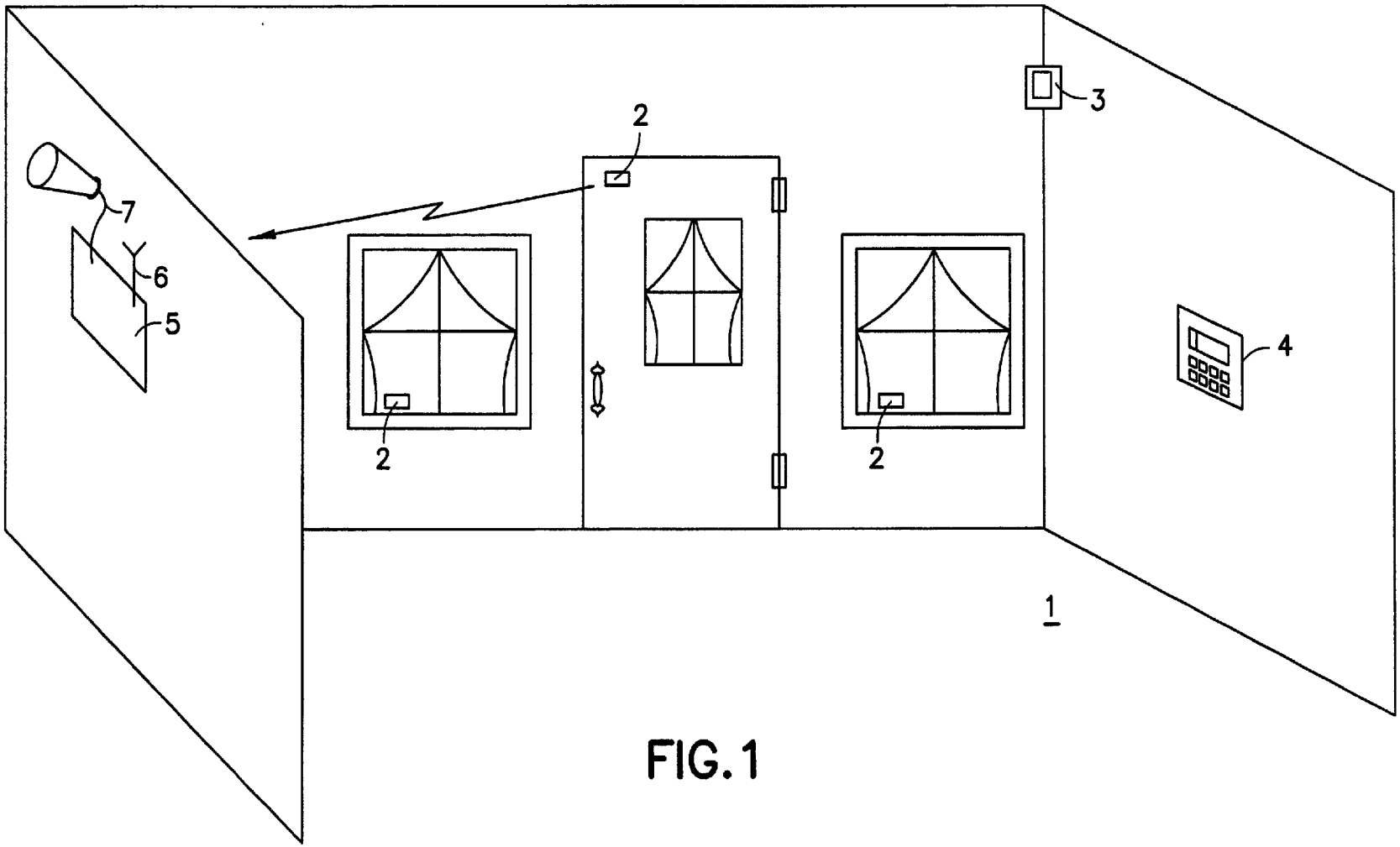
FIG. 1 is a diagram of an alarm system with singular housing sensors.

With respect to the first aspect of the invention (the magnetic field sensor), FIG. 1 shows an area monitored by an alarm system 1. The alarm system 1 comprises three singular housing sensors 2, on three entrance closures—a door and two windows; a motion detector 3; a keypad 4; a control 5 (in a remote location); a wireless receiver 6; and a siren 7. The detection of an intruder by an alarm system 1, as well known in the art, is as follows: a user arms the alarm system 1 by pressing a user code on the keypad 4. The keypad 4 sends an arm message with the code to the control 5. The sensors 2 and 3 monitor a change in conditions, i.e. if the door or windows are open or if motion has been detected. If there is a change in conditions, the sensors 2 and/or 3 send an alarm message to the wireless receiver 6 that causes the control 5 to sound the siren 7 (or dial a central station as known in the art). Alternatively, the alarm system 1 may correlate alarm messages from a singular housing sensor 2 and the motion detector 3 before sounding the siren 7.

The detection of an intruder by an alarm system 1 that uses singular housing sensors 2 is the same as alarm systems of the prior art. The difference between the present invention alarm system 1 and the prior art alarm systems is that the door and window sensors of the prior art contain two housings, one housing with a magnet located on the door or window and one housing with a switch located on the doorjamb or windowsill (or vice versa). In the prior art, when the door or window is opened, the magnet moves away from the switch causing the switch to change positions. The change in the switch position causes an alarm message to be transmitted to the receiver 6. In the present invention, the singular housing sensor 2 has only one housing located on the window or door being monitored.

Figure 2:
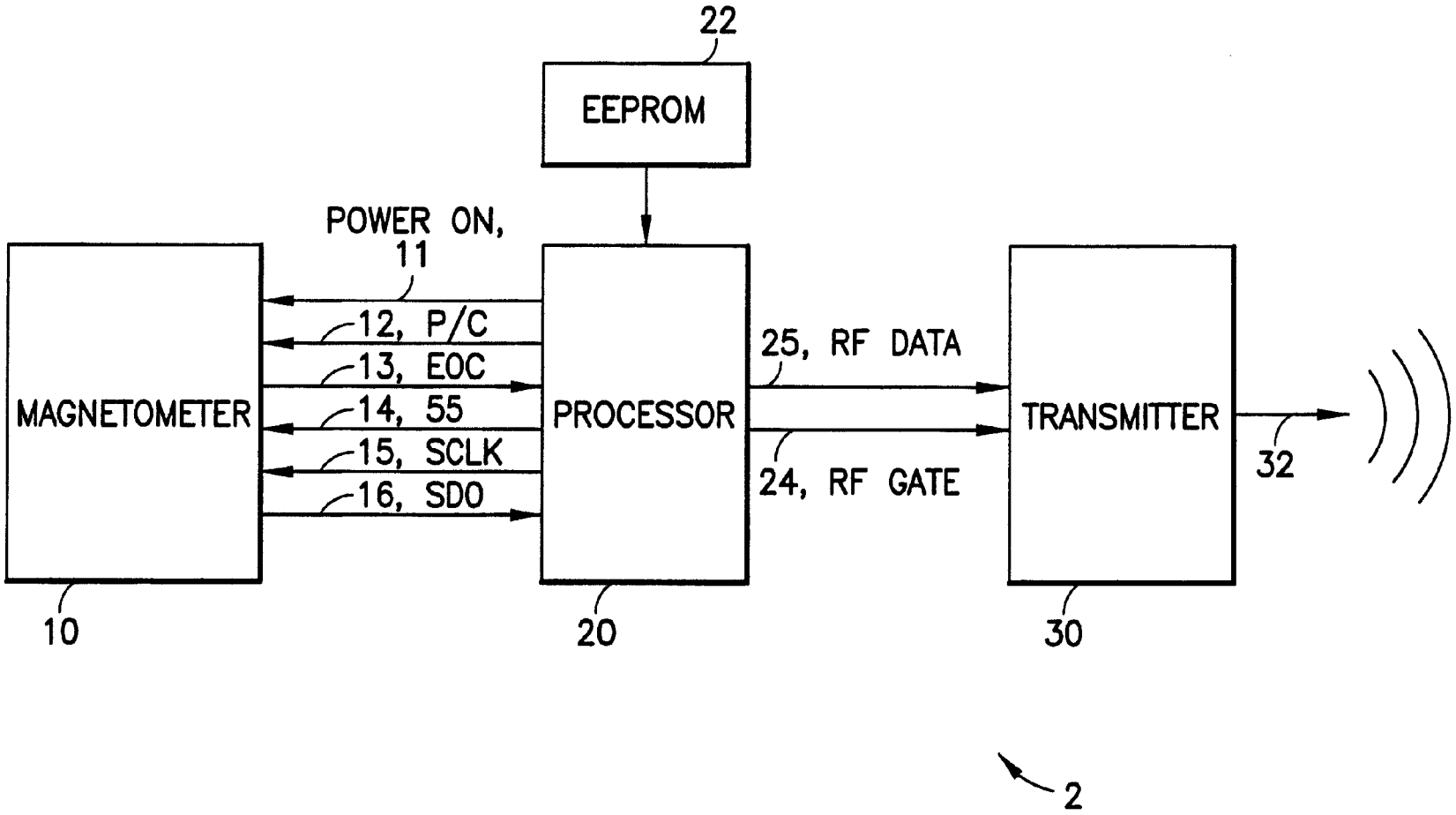
FIG. 2 is a block diagram of a singular housing sensor.

As shown in FIG. 2, the singular housing sensor 2 contains a magnetometer 10, a processor 20 and a transmitter 30. When the door or window is moved, the magnetometer 10 senses a change in the earth's magnetic field. The processor 20 determines when the magnetometer's 10 output has changed by a predefined amount and initiates the transmitter 30 to transmit an alarm message to the receiver 6.

The magnetometer 10 (for example, a commercially available model from Precision Navigation) senses a change in the earth's magnetic field in the following manner: an accurate reference signal with a 4 MHz frequency, produced by a crystal oscillator, is compared to the natural frequency of three inductance/resistance (LR) circuits one at a time. Each circuit is oriented orthogonally in the singular housing so as to sense X, Y, and Z directions. The natural frequency of the LR circuit is affected by the magnetic flux through the LR circuit, essentially it is a flux to frequency converter. The magnetic flux, and therefore the frequency of the resultant signal, is not only dependent on the value of the inductance and resistance components, but also on the relative position of the LR circuit to the earth's magnetic field. Therefore, a change in the position of the magnetometer 10 produces a resultant signal with a different frequency. The magnetometer 10 also comprises a state machine that drives the current through each of the sensor's LR circuits, such that they are biased in both directions, first measuring the frequency in a certain polarity with an up-counter, then driving the signal through the LR circuits in the reverse polarity, measuring frequency with the counter switched so as to count down. The final count is an indication of the magnetic field direction and strength relative to the reference signal, and it is proportional to magnetic flux at that location. The final count for each direction is a signed 16 bit word which is stored for transmission to the processor 20.

The interface between the magnetometer 10 and the processor 20 in the present invention will now be described. The processor 20 provides power to the magnetometer 10 using Power On signal 11. This allows the processor 20 to conserve power by only turning the magnetometer 10 on when the processor 20 will be collecting data. Once the power is on, the processor pulls the P/C signal 12 low for at least 10 msec. A low level on the P/C signal 12 causes the magnetometer 10 to pull the EOC signal 13 low and to start its calculations as described above. The magnetometer 10 causes the EOC signal 13 to go high again when the data is ready to be retrieved (about 100 msec). In order for the processor 20 to read the data, the processor 20 must pull SS signal 14 low and provide 48 clock cycles on SCLK signal 15. On each of the rising edges of the SCLK signal 15, the magnetometer 10 will provide one bit of the 48-bit data word onto SD0 signal 16. The 48-bit data word contains three signed 16-bit integers. The first is from the X-axis, the second is from the Y-axis, and the third is from the Z-axis. Once the complete data word is read by the processor 20, it pulls the SS signal 14 high and discontinues the Power On signal 11. The processor 20 next processes the data and determines if an alarm condition exists, as described below. If an alarm condition does exist, the processor 20 generates an alarm message containing the unique transmitter identification number programmed in EEPROM 22, enables the transmitter 30 with RF gate signal 24, and sends the alarm message to the transmitter 30 on RF data signal 25. The transmitter 30 then transmits the alarm message from antenna 32 to the receiver 6.

Figure 3:
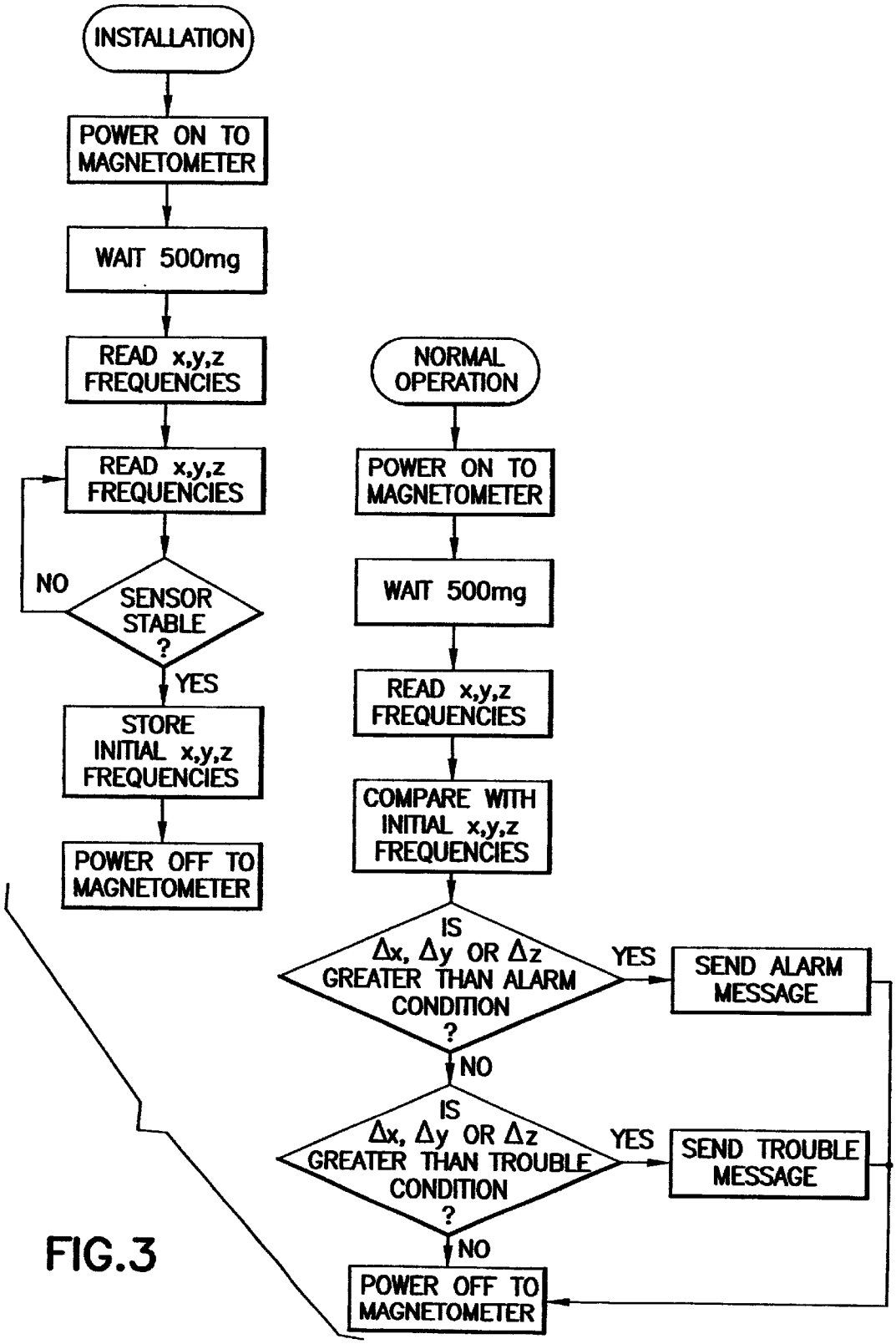
FIG. 3 is flow chart of the operation of a singular housing sensor.

Shown in FIG. 3 is a flow chart for the processing of the data from the magnetometer 10 by the processor 20. During installation of the alarm system, the processor 20 performs a set up mode, where it determines the initial coil frequencies from the magnetometer 10. In this mode, the processor 20 enables power to the magnetometer 10 and waits 500 msecs before reading the data from the magnetometer 10, as described above. The processor 20 reads the data again and possibly a number of times until the data is stable, i.e. the coil frequency is the same for each reading. Once the data is stable, the processor stores the X, y, and z coil frequencies and turns the power off. After the set up mode is completed, the processor 20 turns power on to the magnetometer 10 at a periodic interval, sampling the X, Y, and Z coil frequencies each time, comparing them to the stored initial coil frequencies and determining if the difference is greater than an alarm threshold and if not than a trouble threshold. If the difference is greater than the alarm threshold, the processor causes an alarm message to be transmitted from the transmitter 30. If the difference is not greater than the alarm message, but is greater than the trouble threshold, a trouble message is transmitted. The trouble threshold is smaller than the alarm threshold and indicates that the door is slightly ajar. This is useful during arming of the alarm system. If the difference is not greater than either threshold the processor 10 removes power from the magnetometer 10.

It will be apparent to those skilled in the art that modifications to the specific embodiments described herein may be made while still being within the spirit and scope of the present invention. For example, the alarm message or trouble message may be transmitted when the difference between the initial x, y, and z coil frequencies and the sampled x, y, and z coil frequencies is above a predetermined threshold for two out of the three samples, or may be the predetermined threshold is different for each of the x, y, and z axes.

The second aspect of the invention for monitoring motion detection is a wireless asset management arrangement that senses the gravitational force between the sensitive axes of a sensor and the Earth; if the measured forces are inconsistent with the application an alarm signal will be transmitted. When this sensor is affixed to an object the gravitational force (G) measured in the x and y-axes should not change significantly over time if the object is not moved. If the object is moved from its location the sensor will experience fluctuations in the x and y axis G measurements due to the changes in angle between the object and the Earth. Such an event will cause the sensor to transmit an alarm signal. As an example, when this sensor is affixed to an upright person, the G force measured in the x-axis should be close to zero and close to one in the y-axis. If the person falls to the floor the x-axis will measure close to one G and the y-axis will measure close to zero G. Such a condition will cause the sensor to transmit an alarm signal without intervention from the person.

Figure 4:
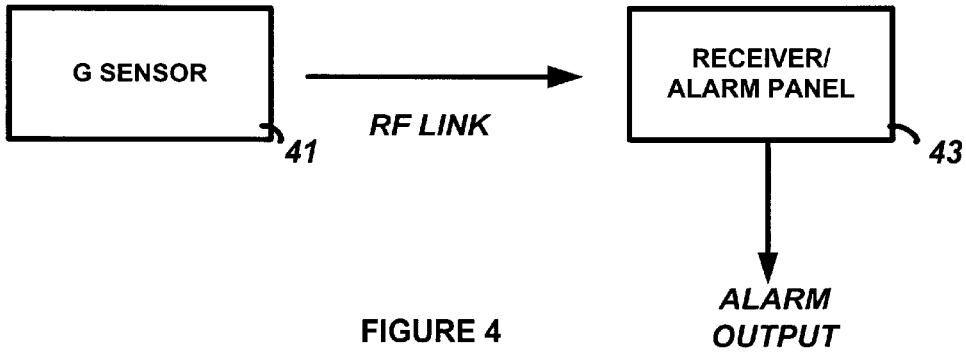
FIG. 4 is a block diagram of the gravitational field monitoring device of this invention.

FIG. 4 illustrates the system block diagram of the wireless gravitational field sensor system. The sensor 41 is a small, self-contained, battery powered device that measures both static and dynamic gravitational force in its sensitive axes. If the x-axis of the sensor 41 is perpendicular to the earth it will measure the static force due to gravity (1G). If the x-axis is parallel to the earth it will measure zero G due to the Earth's gravitational field. At angles between zero and ninety degrees, the sensor will measure a G force between zero and one G proportional to the angle. The y-axis of the sensor functions in a similar fashion. Alarm and supervision signals are transmitted to the receiver via the RF link as known in the art. The receiver 43 processes transmissions from the sensor 41 and determines the appropriate response based on preprogrammed parameters.

Optionally, the device may have a self-contained sounder or display that can emit audible or visual alarm signals when the device is moved and the change with respect to the gravitational field is sensed, thus operating in a stand-alone manner.

Figure 5:
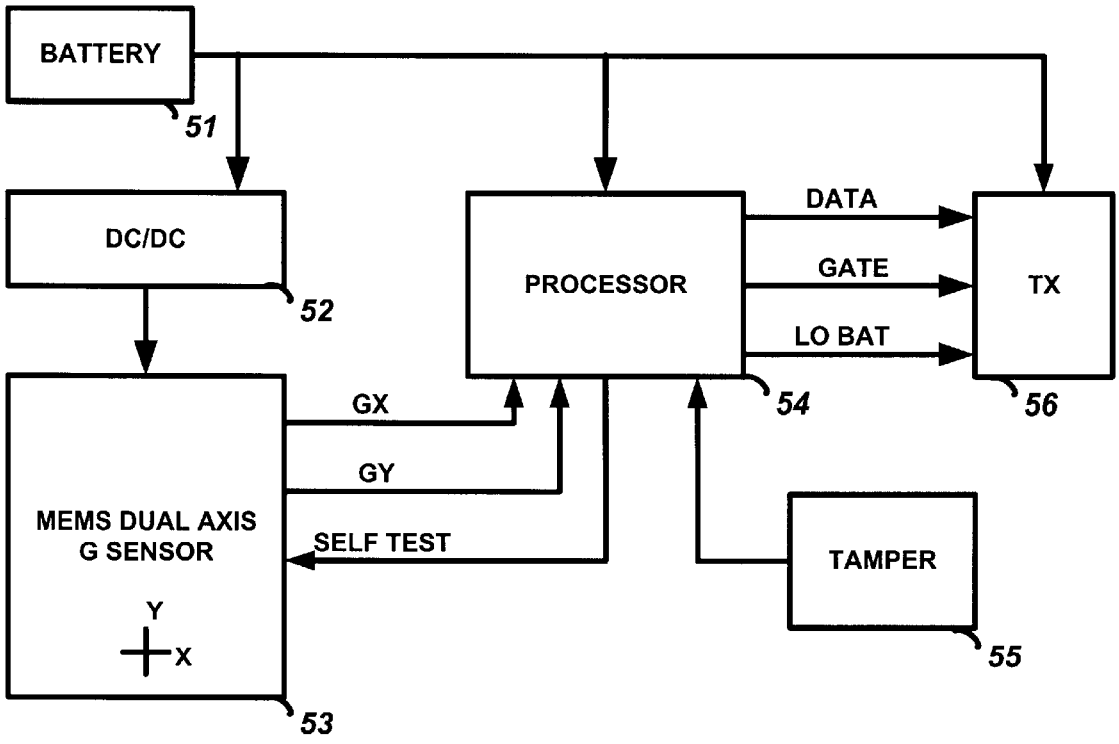
FIG. 5 is a block diagram of the sensor of FIG. 4.

FIG. 5 illustrates a block diagram of the sensor 41. Battery 51 is a single three-volt lithium cell that supplies power for all of the components of the sensor. The DC—DC converter 52 is a circuit known in the art that converts the battery voltage to a constant 3-volt supply required by the G sensor 53. This circuit ensures that the G sensor will have its minimum operating voltage as the battery discharges and the battery voltage subsides. The G sensor 53 is a MEMS dual-axis accelerometer (for example, ANALOG DEVICES, part no. ADXL202E (Dual-Axis Accelerometer with Duty Cycle Output) that will measure +/−2 G in both the x and y-axes. The outputs of this sensor are coupled to a processor 54, which monitors the G forces (GX, GY) and sends an alarm signal via the RF transmitter 56 in accordance with the methodology described below. In addition to monitoring the G forces, the processor 54 will monitor the tamper input 55 for case tampering and will initiate the self-test feature of the sensor to monitor system operation.

As indicated in the data sheets of the ANALOG DEVICES ADXL202E sensor 53, the outputs GX, GY of the sensor 53 are signals whose duty cycles (i.e. the ratio of pulse width to period) are proportional to the gravitational field. Gx and Gy are output in both analog and digital format. The system designer may use either format as desired, but it is noted that the analog output consumes less power than the digital output and is better suited for wireless applications that require low power consumption. These duty cycle outputs are measured by the processor 54 to determine the relative changes over a given period of time and ascertain if an alarm should be triggered. A zero G measurement by the sensor 53 produces a nominally 50% duty cycle. The acceleration (gravitational) signal can be determined by measuring the length of the pulse on and off time by the processor 54.

The determination of a change in the signals produced by the sensor 53 may be accomplished in the same or similar manner as with the first aspect of he invention described above. That is, signal samples may be stored when the housing is at rest, in order to obtain a baseline or quiescent state. These data may be stored, and the signals sampled at intervals and then compared to the previously stored samples. When changes in the sensor signals are determined by these data comparisons, and such changes exceed certain predetermined thresholds (to account for noise, drift, etc.), then the alarm signals may be generated.

The preferred embodiment processes the G inputs to determine if an alarm condition exists as follows. In order to help prevent false triggers (such as those that might by be caused by noise spikes and the like), a moving average filter is used to smooth the signals being monitored. By taking a predetermined number of samples, storing them in memory, and averaging the samples, the effects of a noise spike will be ameliorated so that false triggering may be prevented. The following formula is used to provide the moving average in this invention:

Moving average calculation $$G_{avg}(n) := \frac{1}{N} \cdot \sum_{k=0}^{N-1} G(n-k)$$

N is the number of values to average

For example, in the preferred embodiment, the number of values that are averaged (N) is four. By using this methodology, the calculated $G_{avg}$ signal will always be the average of the last four samples taken. Of course, the number of samples used (N) may vary in accordance with the desires of the system designer, available processing power, etc.

Tilt sensitivity of the sensor varies as a function of the relative position of the device with respect to the gravitational field of the earth. The sensor is actually measuring the vertical component of a gravity vector. Thus, for a given angular displacement, the vertical gravity component will be different for different positions of the sensor.

Figure 6:
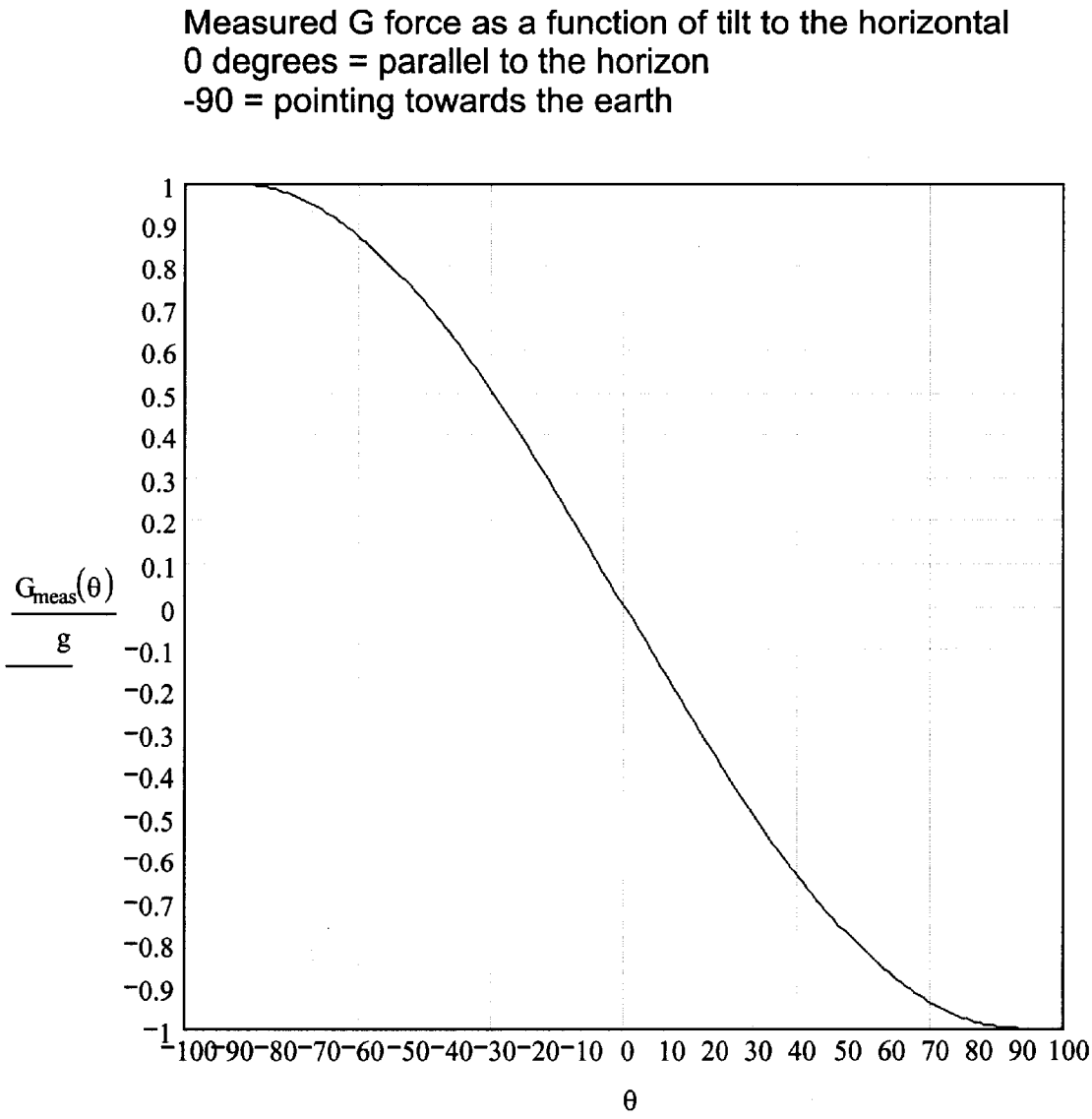
FIG. 6 illustrates the measured G force as a function of tilt to the horizontal axis.

With reference to FIG. 6, the following equation is used in this invention for determining the measured G force as a function of the angle between the horizon and the sensor:

$$G_{meas}(\theta) := -g \cdot \sin\left(\frac{\pi}{180} \cdot \theta\right)$$

Figure 7:
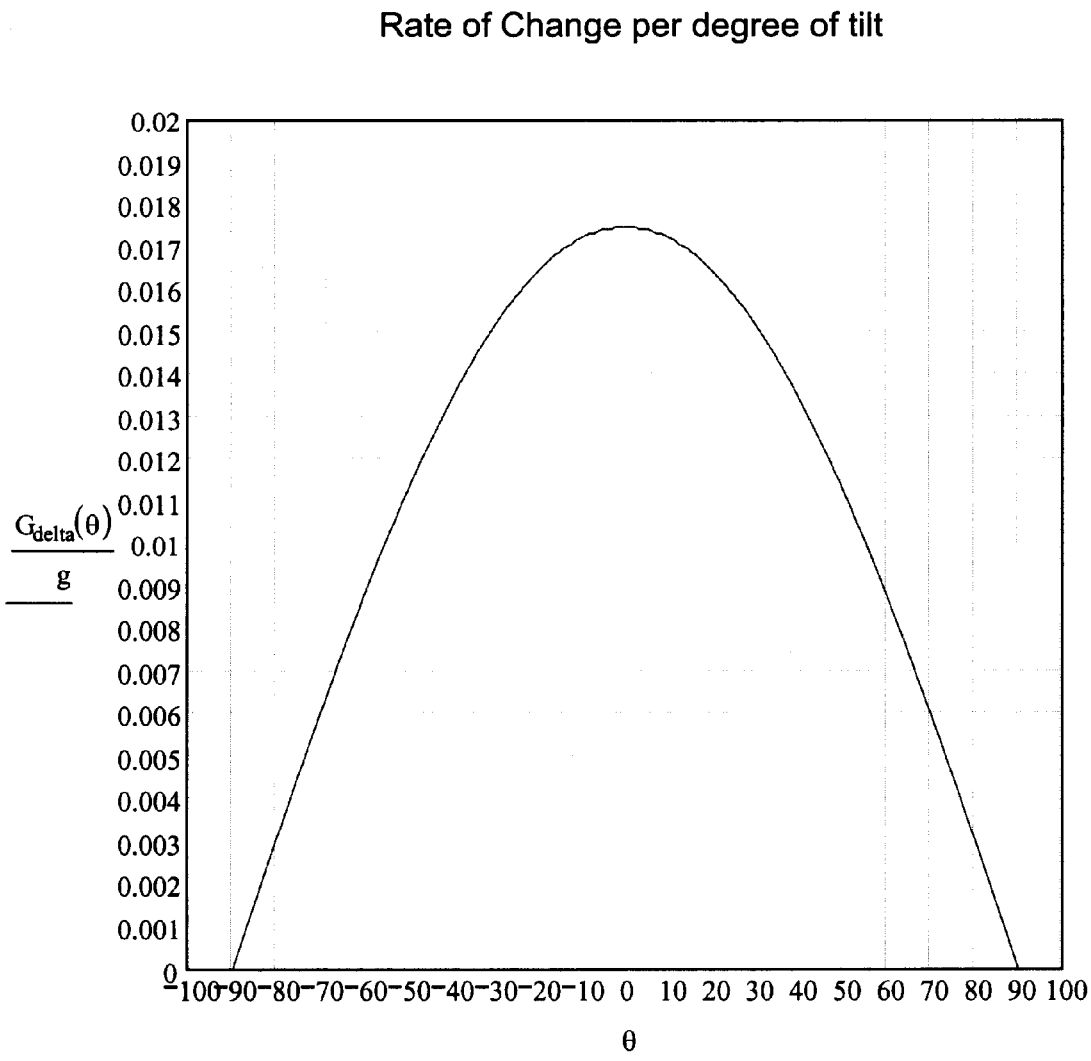
FIG. 7 illustrates the rate of change per degree of tilt.

Equation for measured g force as a function of angle (θ) between the horizion and the sensor where g is the known constant for gravity (9.8 m/s$^2$). FIG. 6 illustrates the measured G force as a function of tilt to the horizontal axis (0 degrees is parallel to the horizon and −90 degrees is pointing towards the earth), and FIG. 7 illustrates the rate of change per degree of tilt. As can be seen, the sensor is most sensitive when it is parallel to the earth (0.174 g/degree tilt) and least sensitive when the sensor is perpendicular to the earth (<0.001 g/degree tilt). For an alarm threshold of 10 degrees of tilt, when the sensor is parallel to the earth it will measure a change of 0.174G. For the same 10 degrees of tilt when the sensor is perpendicular to the earth it will measure a change of 0.015 g. As such, to compensate for these variations, the alarm threshold needs to change based on the orientation of the sensor.

For example, when the sensor is oriented with a rest angle of 0 degrees (at horizontal), and the sensor is then tilted by 10 degrees, then Tilt calculations RestAngle:=0

Tilt:=10

$$DeltaG(\theta 1, \theta 2) := \left|-g \cdot \sin\left(\frac{\pi}{180} \cdot \theta 1\right) - -g \cdot \sin\left(\frac{\pi}{180} \cdot \theta 2\right)\right|$$

GChange:=DeltaG (RestAngle, RestAngle−Tilt)

GChange=0.174 g

The device preferably implements a lookup table in memory to determine the appropriate threshold to use in determining if an alarm should be triggered. The threshold values are calculated using the equations provided above for a desired sensitivity, which is 10 degrees in the preferred embodiment (any change under 10 degrees does not trigger the alarm, and any change over 10 degrees triggers the alarm). The threshold values for a range of rest angles are calculated ahead of time and stored in a look up table associated with the processor. The processor will then look up the required threshold value based on the rest angle at a given time, which is determined from the Gx and Gy signals provided by the sensor. In the alternative, the calculations may be made on the fly without pre-storage in memory (for example with a digital signal processor), but that methodology results in a delay (due to processing) that will slow down the response time until an alarm may be triggered.

Although a preferred embodiment may use a 10 degree threshold for triggering the alarm, the device may alternatively use several user-selectable thresholds. For example, appropriate thresholds for several angles—5 degrees, 10 degrees, and 15 degrees—may be precalculated and stored in memory. The device may be provided with a DIP switch or other type of user-accessible switch for selecting the appropriate threshold to use. A user desiring a more sensitive alarm device would select the 5 degree thresholds, while a user desiring al less sensitive device would select the 15 degree threshold.

The present invention may be configured to monitor two axes, as described above, and it also may be configured to monitor only of the two axes, or it may monitor three axes by using two devices juxtaposed so that the x, y and z axes are monitored.

It is noted that either of the first aspect of the invention (the magnetic field monitoring device) or the second aspect of the invention (the gravitational field monitoring device) may be used to detect a change on position of an item such as a painting or a laptop computer, or to monitor the movement of a person (such as an elderly person or firefighter in a "man-down" scenario), or may be used to monitor opening of a door or window, all as previously described. Due to the ability of either device to detect change in position or movement with respect to a naturally occurring physical property (i.e., magnetic field or gravitational field of the earth), each invention is advantageous over prior art devices attempting to accomplish the same objectives.

In addition, the present invention may be used advantageously to detect the opening of a roll-up garage door, by attaching the housing on the door such that its position changes at some point when the door is opening or closing (i.e. goes from a vertical orientation to a horizontal orientation or vice versa). Preferably, the housing is mounted near the top of the door so that it changes position as soon as the door is retracted.

We claim:

1. A method of generating an alarm signal upon detecting a change in position of an object comprising the steps of:

a) locating a housing with respect to the object;

b) monitoring, with apparatus in the housing, the gravitational field of the earth;

c) detecting, with apparatus in the housing, a change in the position of the housing with respect to the gravitational field of the earth;

d) generating an alarm signal upon detecting a change in position of the housing with respect to the gravitational field of the earth that exceeds a first predetermined threshold; and e) transmitting by wireless transmission the alarm signal to a remote receiving station.

2. The method of claim 1 wherein the housing is located with respect to the object by affixing the housing to the object.

3. The method of claim 1 wherein the housing is located with respect to the object by hanging the housing from the object.

4. The method of claim 1 wherein said apparatus in the housing comprises:

a) a gravitational sensor that detects the earth's gravitational field and generates an output signal, wherein the output signal is correlated to the earth's gravitational field;

b) processing means for detecting a change in the output signal from the gravitational sensor, and for generating an alarm signal when the change is greater than the first predetermined threshold; and c) an RF transmitter for transmitting the alarm signal.

5. The method of claim 4 wherein said detecting step comprises the steps of:

i. determining a static output signal from the gravitational sensor;

ii. storing the static output signal from the gravitational sensor; and iii. sampling the output signal from the gravitational sensor at a predetermined time interval.

6. The method of claim 5 wherein said detecting step further comprises the steps of:

iv. subtracting the sampled output from the gravitational sensor from the stored static output of the gravitational sensor to produce a difference value; and v. determining if the absolute value of the difference value is greater than the first predetermined value.

7. The method of claim 1 wherein said step of detecting a change in the position of the housing with respect to the gravitational field of the earth takes place on two axes.

8. The method of claim 7 wherein said step of generating an alarm signal occurs upon detecting a change in position of the housing in one of the two axes.

9. The method of claim 1 further comprising the step of generating a trouble signal upon detecting a change in position of the housing with respect to the gravitational field of the earth that exceeds a second predetermined threshold.

10. The method of claim 9 wherein the second predetermined threshold is less than the first predetermined threshold.

11. An apparatus for generating an alarm signal upon detecting a change in position of a housing comprising:

a) means for monitoring the gravitational field of the earth;

b) means for detecting a change in the position of the housing with respect to the gravitational field of the earth;

c) means for generating an alarm signal upon detecting a change in position of the housing with respect to the gravitational field of the earth that exceeds a first predetermined threshold; and d) means for transmitting by wireless transmission the alarm signal to a remote receiving station.

12. The apparatus of claim 11 wherein said means for monitoring the gravitational field of the earth comprises:

i. a gravitational sensor that detects the earth's gravitational field and generates an output signal, wherein the output signal is correlated to the earth's gravitational field; and ii. processor means for sampling the output signal and evaluating it.

13. The apparatus of claim 12 wherein said means for detecting a change in the position of the housing with respect to the gravitational field of the earth comprises:

i. means for determining a static output signal from the gravitational sensor;

ii. means for storing the static output signal from the gravitational sensor; and iii. means for sampling the output signal from the gravitational sensor at a predetermined time interval.

14. The apparatus of claim 13 wherein said means for detecting a change in the position of the housing with respect to the gravitational field of the earth comprises:

iv. means for subtracting the sampled output from the gravitational sensor from the stored static output of the gravitational sensor to produce a difference value; and v. means for determining if the absolute value of the difference value is greater than the first predetermined value.

15. The apparatus of claim 11 wherein the means for detecting of change in the position of the housing with respect to the gravitational field of the earth detects said change on two axes.

16. The apparatus of claim 15 wherein said means for generating an alarm signal generates an alarm signal upon the detection of a change in position of the apparatus in one of the two axes.

17. The apparatus of claim 11 wherein the alarm signal contains a unique transmitter identification number.

18. A security system comprising:

a) a single-housing motion sensing device comprising:

i. means for monitoring the gravitational field of the earth;

ii. means for detecting a change in the position of the housing with respect to the gravitational field of the earth;

iii. means for generating an alarm signal upon detecting a change in position of the housing with respect to the gravitational field of the earth that exceeds a first predetermined threshold; and iv. means for transmitting by wireless transmission the alarm signal to a remote receiving station; and b) a receiving station located remotely from the single-housing motion sensing device comprising:

i. means for receiving by wireless transmission the alarm signal, and ii. means for indicating an alarm condition in response to receipt of the receipt of the alarm signal.

19. The security system of claim 18 wherein said means for monitoring the gravitational field of the earth comprises:

i. a gravitational sensor that detects the earth's gravitational field and generates an output signal, wherein the output signal is correlated to the earth's gravitational field; and ii. processor means for sampling the output signal and evaluating it.

20. The security system of claim 19 wherein said means for detecting a change in the position of the housing with respect to the gravitational field of the earth comprises:

i. means for determining a static output signal from the gravitational sensor;

ii. means for storing the static output signal from the gravitational sensor; and iii. means for sampling the output signal from the gravitational sensor at a predetermined time interval.

21. The security system of claim 20 wherein said means for detecting a change in the position of the housing with respect to the gravitational field of the earth comprises:

iv. means for subtracting the sampled output from the gravitational sensor from the stored static output of the gravitational sensor to produce a difference value; and v. means for determining if the absolute value of the difference value is greater than the first predetermined value.

* * * * *